United States Patent [19]

Shibata et al.

[11] Patent Number: 4,548,848

[45] Date of Patent: Oct. 22, 1985

[54] HIGH DENSITY, WATER-REPELLENT TEXTILE FABRIC

[75] Inventors: Fumio Shibata, Uji; Shunzo Kawasaki, Kashiwara, both of Japan

[73] Assignee: Teijin Limited, Osaka, Japan

[21] Appl. No.: 606,643

[22] Filed: May 3, 1984

[30] Foreign Application Priority Data

May 4, 1983 [JP] Japan ..... 58-77388
May 16, 1983 [JP] Japan ..... 58-84044
Aug. 12, 1983 [JP] Japan ..... 58-146571

[51] Int. Cl.[4] ..... D03D 15/04; D03D 27/00

[52] U.S. Cl. ..... 428/85; 26/8 R; 26/18.5; 26/29 R; 38/144; 139/383 R; 139/420 A; 139/426 R; 427/393.4; 428/91; 428/152; 428/229; 428/265; 428/267; 428/422

[58] Field of Search ..... 139/383 R, 420 A, 426 R; 428/85, 91, 152, 229, 422, 265, 267

[56] References Cited

U.S. PATENT DOCUMENTS 3,373,774 3/1968 Cruz ..... 139/426 R
4,191,218 3/1980 Clark et al. ..... 139/383 R
4,234,022 11/1980 Okamoto et al. ..... 139/426 R

FOREIGN PATENT DOCUMENTS 48172 3/1979 Japan .

*Primary Examiner*—James C. Cannon
*Attorney, Agent, or Firm*—Burgess, Ryan & Wayne

[57] ABSTRACT

A high density textile fabric having an excellent water-repellent property comprises a woven fabric having at least one water-repellent surface layer formed by a number of warps and wefts each consisting of a number of extremely fine, water-repellent fibers having a denier of 1.2 or less, the surface layer having a sum of cover factors (CF) in the warp and weft directions thereof, of from 1,400 to 3,400 determined in accordance with the equation:

$$CF = n\sqrt{de}$$

wherein n represents the number of the warps or wefts per inch of the fabric and de represents a denier of the warps or wefts.

18 Claims, No Drawings

HIGH DENSITY, WATER-REPELLENT TEXTILE FABRIC

BACKGROUND OF THE INVENTION

1. Field of the Invention

The present invention relates to a textile fabric having a high density and an improved water-repellent property. More particularly, the present invention relates to a textile fabric comprising extremely fine fibers, having a finely rugged surface, and exhibiting a high density and an improved water-repellent property. The textile fabric is useful for producing umbrellas, raincoats, sportswear, and other outdoor clothes.

2. Description of the Prior Art

Various types of water-proof textile fabrics are known. For example, Japanese Unexamined Patent Publication (Kokai) No. 54-48172 discloses a water-proof fabric which comprises a woven fabric substrate comprising thermoplastic synthetic multifilaments and having one or two needle-punched surfaces with a disturbed weave structure of the fabric and opened multifilaments; and a fluff layer, formed on only one surface of the woven fabric, comprising a number of individual filaments in the form of loop piles having a height of 5 mm or less. This type of water-proof fabric exhibits a preferable gloss and hand and exhibits loop piles effective for enhacing the bonding property of the woven fabric surface to a water-proof coating. However, the above-mentioned type of water-proof fabric exhibits an unsatisfactory water-repellent property.

On another subject, various types of outdoor clothes having a high density are available. Such clothes are required to exhibit satisfactory moisture-permeability, a water-repellent property, and a high wind-breaking property (low wind-passing property). However, conventional high density water-proof fabrics usually exhibit an unsatisfactory water-repellent property. This is due to the smooth surface of the high density fabric.

SUMMARY OF THE INVENTION

An object of the present invention is to provide a high density textile fabric having an excellent water-repellent property.

The above-mentioned object can be attained by the high density, water-repellent textile fabric of the present invention, which comprises a woven fabric comprising a number of warps and wefts each consisting of a number of extremely fine, water-repellent fibers having a denier of 1.2 or less, which woven fabric has at least one finely rugged surface having a sum of cover factors in warp and weft directions of the fabric, from 1,400 to 3,400, which has been determined in accordance with the equation:

$$CF = n\sqrt{de}$$

wherein CF represents the cover factor of the fabric surface in the warp or weft direction thereof, n represents the number of the warps or wefts per inch in the fabric and de represents a denier of each warp or weft in the fabric.

The woven fabric surface preferably has a water-repellent layer comprising a number of extremely fine, water-repellent fluffs extending outward from the fabric surface.

Also, the high density, water-repellent textile fabric may be a double weave composed of a surface weave layer corresponding to the finely rugged fabric surface and a back weave layer. The back weave layer comprises a number of warps and wefts each consisting of a number of extremely fine synthetic filaments having a denier of 1.1 or less and having a sum of cover factors in the warp and weft directions of from 1,600 to 2,400. The surface weave layer comprises a number of warps and wefts each consisting of a number of thermoplastic synthetic filaments having a denier of from 1.0 or more and having a sum of cover factors in the warp and weft directions of from $\frac{1}{4}$ to 1.0 time that of the back weave layer. The surface weave layer exhibits an excellent water-repellent property, while the back weave layer exhibits an enhanced wind-breaking property (low wind-passing property).

DESCRIPTION OF THE PREFERRED EMBODIMENTS

In high density, water-repellent textile fabric, it is important that the woven fabric have at least one finely rugged water-repellent surface. That is, the finely rugged surface preferably has a number of fine concavities and convexities each having a size of 1000 microns or less, more preferably, from 1 to 150 microns still more preferably 30 to 100 microns. These fine concavities and convexities are highly effective for repelling water from the fabric surface.

Usually, if the size of the concavities and convexes is more than 1000 microns, the concavities may hold fine water drops and, therefore, the fabric surface may exhibit an unsatisfactory water-repellent property.

The finely rugged surface of the woven fabric is formed by using warps and wefts each comprising a number of extremely fine fibers having a denier of 1.2 or less. Also, it is important that the finely rugged surface of the woven fabric exhibits a sum of cover factors in the warp and weft directions of the fabric of from 1,400 to 3,400.

The cover factors are determined in accordance with the equation:

$$CF = n\sqrt{de}$$

wherein CF represents the cover factor of the fabric surface in the warp or weft direction thereof, n represents the number of the warps or wefts per inch in the fabric, and de represents a denier of each warp or weft in the fabric.

When the denier of the extremely fine fibers in the finely rugged surface of the woven fabric is more than 1.2 and/or the sum of the cover factors in the warp and weft directions of the finely rugged surface is less than 1,400, the resultant finely rugged surface exhibits an unsatisfactory water-repellent property.

If the sum of the cover factors in the warp and weft directions of the finely rugged surface is more than 3,400, the resultant surface exhibits an undesired paper-like stiff hand.

The water-repellent textile fabric of the present invention may be obtained by treating one or both surfaces of the woven fabric with a water-repellent agent, for example, a silicone compound or fluorine-containing organic compound in accordance with a conventional method. For example, the woven fabric can be coated or impregnated with the water-repellent agent by means of conventional spraying, padding, immersing, or coating. Usually, the padding method is most effective for uniformly imparting a high water-repellent property to the woven fabric surface.

The warps and wefts of the woven fabric comprise at least one type of extremely fine cut fibers or extremely fine filaments, which may be selected from polyester, polyamide, and polyolefin fibers or filaments.

The extremely fine cut fibers or extremely fine filaments may be ones produced from islands-in-sea type composite fibers or filaments or divisible type composite fibers in accordance with conventional procedures.

The warps and wefts may comprise a single type of extremely fine, water-repellent synthetic multifilaments, especially, polyester multifilaments, or a blend of at least two types of extremely fine, water-repellent synthetic multifilaments, for example, a blend of extremely fine, water-repellent polyester filaments and polyamide filaments.

The blend of the polyester filaments and the polyamide filaments may be prepared by dividing the divisible composite filaments composed of filamentary polyester constituents and filamentary polyamide constituents arranged alternately and extending in parallel to each other.

The high density, water-repellent textile fabric of the present invention preferably has a water-repellent layer comprising a number of extremely fine, water-repellent cut pile-formed fluffs extending outward from the fabric surface. The fluffs have a height of 1,000 microns or less, preferably from 10 to 100 microns. If the height of the fluffs is more than 1000 microns, the resultant fluff layer usually exhibits an unsatisfactory water-repellent property.

The extremely fine cut pile-formed fluff layer can be formed by raising a surface of the woven fabric comprising the extremely fine fiber or filaments so as to form a number of fluffs in the form of cut piles.

The fluffs in the water-repellent layer may be in the form of loop piles. The loop-pile formed fluffs can be prepared in the following manner.

A woven fabric is produced from a number of warps and wefts each comprising at least two types of extremely fine synthetic filaments different in heat shrinkage thereof. The woven fabric is subjected to heat treatment to such an extent that at least one type of the synthetic filaments exhibits a heat shrinkage of 7% more than that of the other type of filaments. In this heat treatment, the other type of filaments with the small heat shrinkage forms fluffs in the form of loop piles extending outward from the fabric surface.

That is, it is preferable that the difference in the heat shrinkage between two or more types of the synthetic filaments be 7% or more, more preferablty 7% to 15%, under the heat-treating conditions under which the woven fabric is treated.

The above-mentioned heat treatment may be combined with the raising treatment on the woven fabric.

When the fluff layer is formed on the woven fabric surface, it is preferably that the water-repellent treatment be applied to the woven fabric after the fluff layer is formed thereon.

The high density, water-repellent textile fabric of the present invention can be produced from one or more types of textured extremely fine multifilaments.

In order to enhance the wind-breaking property (or decrease the wind-passing property), it is preferable that the high density, water-repellent fabric be subjected to a heat-calendering procedure.

The high density, water-repellent textile fabric of the present invention may include a double weave composed of a surface weave layer corresponding to the finely rugged surface and back weave layer. The back weave layer comprises a number of warps and wefts each consisting of a number of extremely fine synthetic filaments having a denier of 1.1 or less and has a sum of cover factors in the warp and weft directions of from 1,600 to 2,400. The surface weave layer comprises a number of warps and wefts each consisting of a number of thermoplastic synthetic filaments having a denier of 1.0 or more and has a sum of cover factors in the warp and weft directions of from $\frac{1}{4}$ to 1.0 time that of the back weave layer.

In the above-mentioned double weave, the surface weave layer exhibits an excellent water-repellent property. The back weave layer contributes to an excellent wind-breaking propety (low wind-passing property) of the double weave.

In order to provide a back weave layer having an enhanced wind-breaking property, it is preferable that the ratio of the cover factor in the warp direction to that in the weft direction of the back weave layer be in the range of from 49:51 to 70:30 and that the sum of the cover factors in the warp and weft directions be in the range of from 2,000 to 2,400.

In order to further enhance the wind-breaking property (or further decrease the wind-passing property), it is preferable that the high density, water-repellent fabric be subjected to a heat-calendering procedure to an extent that the air permeability of the fabric is reduced to a level of 3 $ml/cm^2 \cdot sec$ or less.

It is preferable that the surface weave layer be produced from a single type of synthetic thermoplastic filaments capable of shrinking at an elevated temperature. Otherwise, two ro more types of synthetic thermoplastic filaments differnet in heat shrinkage from each other may be used to produce the surface weave layer, for example, the surface weave layer may be produced from a blend of polyester multifilaments and polyamide multifilaments which are different in heat shrinkage from each other. When the surface weave layer is heated at an elevated temperature, at least one type of multifilaments having a small heat shrinkage than that of the other type of multifilaments forms a number of fluffs in the form of loop piles extendig outward from the surface weave layer.

After the heat treatment, the surface weave layer may be subjected to a raising procedure.

The surface weave layer may be pruduced from extremely fine synthetic cut fibers or textured multifilaments. These fibers or filaments may have a regular cross-sectional profile or an irregular cross-sectional propile. Also, the multifilaments may be in the form of a non-twisted yarn or twisted yarn. The textured multifilament yarn usable for the present invention is selected from false-twist textured yarns, stuffer box-textured yarns, edge-crimped yarns, and air-jet textured yarns.

In order to enhance the water-repellent property, it is preferable that the surface weave layer have an air-layer-containing structure effective for preventing undesirable formation of a water layer on the surface weave layer. For this purpose, it is necessary that the sum of the cover factors in the warp and weft directions of the surface weave layer be in the range of from $\frac{1}{4}$ to 1.0 time that of the back weave layer and that the extremely fine fibers or filaments in the surface weave layer have denier of 1.0 or less. The surface weave structure is preferably selected from a mesh structure, twill structure, fancy structure, and mat structure, which are effective for enhancing the water-repellent property of the surface weave layer.

The back weave layer is formed from warps and wefts each comprising extremely fine, water-repellent fibers or filaments having denier of 1.1 or less. The fibers or filaments are effective for forming a back weave layer having a reduced air permeability after the back weave layer is heat calendered. Especially, when extremely fine fibers or filaments having a denier of 0.5 or less are used, the resultant water-repellent double weave fabric of the present invention exhibits a satisfactory softness and hand and is useful for sportswear. Usually, the back weave layer preferably has a plain weave structure.

The double weave fabric is treated with a water-repellent agent by means of a conventional method, for example, a spraying, padding, immersing, or coating method. If desired, the back weave layer of the double weave fabric is heat calendered after the water-repellent treatment. The heat calendering process is effective for enhancing the wind-breaking property of the resultant fabric.

Examples of the present invention and comparative examples are illustrated below.

In the examples and comparative examples, the moisture permeability was determined in accordance with Japanese Industrial Standard (JIS) Z-208, and the air-permeability was determined in accordance with JIS L-1071.

EXAMPLE 1 AND COMPARATIVE EXAMPLE 1

In Example 1, a high density plain weave fabric having a warp density of 177 yarns/3.79 cm and a weft density of 109 yarns/3.79 cm was produced from warps consisting of polyethylene terephthalate multifilament yarns each having a yarn count of 75 denier/ 72 filaments (the denier of individual filament having 1.04), and wefts consisting of multifilament yarns having a denier of 150 produced from 40 composite filaments each composed of 8 filamentary polyethylene terephthalate constituents and 8 filamentary nylon 6 constituents arranged alternately, adhered to each other, and extending in parallel to each other, by dividing the filamentary constituents from each other. The weft multifilament yarn had a yarn count of 150 denier/640 filaments and was composed of individual extremely fine filaments each having a denier of 0.23.

The plain weave fabric was heat-set at a temperature of 180° C. for 45 seconds by a conventional method.

The heat-set fabric was dyed with a usual disperse dye at a temperature of 130° C., soaped, and dried by a conventional process. The dyed fabric had a warp density of 214 yarns/3.79 cm, a weft density of 123 yarns/3.79 cm, and a sum of cover factors in the warp and weft directions of 2,252.

A surface of the dried fabric was raised three times by means of sandpaper (grade: #240).

The raised fabric was subjected to water-repellent treatment with a fluorine-containing resin composition having the following composition.

| | |
|---|---|
| Fluorine-containing water-repellent resin(*1) | 6% |
| Cross-bonding agent(*2) | 0.3% |

-continued

| | |
|---|---|
| Catalyst(*3) | 0.1% |
| Water | 93.6% |

Note:
(*1)Available under a trademark of Asahigard AG 710 made by Asahi Glass Co., Japan.
(*2)Available under a trademark of Unikaresin 380 K made by Union Chemical Co., Japan.
(*3)Available under a trademark of Sumitex Accelerator ACX made by Sumitomo Chemical Co., Japan.

The water-repellent treatment was carried out by means of the padding method. The treated fabric was dried at a temperature of 100° C. and heat treated at a temperature of 180° C. for 30 seconds.

A high density, water-repellent fabric of the present invention was obtained.

The fabric had a sum of cover factors in the warp and weft directions of 2,360, a moisture permeability of 6,000 g/m$^2$·24 hr, and an air permeability of 8.0 ml/cm$^2$·sec.

When water drops were applied onto the raised fabric surface, the water drops were completely repelled as spherical particles and could not wet the fabric.

In Comparative Example 1, the same procedures as those described in Example 1 were carried out, except that no raising procedure was applied to the woven fabric and the resultant fabric had a coarsely rugged surface.

For the purpose of comparison, 0.1 ml of a water drop was placed on each of the raised surfaces of the water-repellent fabrics of Example 1 and Comparative Example 1 by using a syringe needle. The plane configurations and diameters of the water drops on the fabric surfaces were indicated in Table 1.

TABLE 1

| | Plane configuration | Diameter (mm) |
|---|---|---|
| Example 1 | Circle | 7.0 |
| Comparative Example 1 | Oval | major axis: 7.6<br>major axis: 7.3 |

Table 1 shows that the water-repellent property of the water-repellent fabric of Example 1 is superior to that of Comparative Example 1.

EXAMPLE 2

A high density single mat weave fabric having a warp density of 183 yarns/2.54 cm, a weft density of 82 yarns/2.45 cm, and a sum of cover factors in the warp and weft directions of 2829 was prepared from blend filament yarns consisting of a blend of 144 extremely fine polyethylene terephthalate filaments having a total denier of 64 and an individual filament denier of 0.43 and exhibiting a low shrinkage of 8% in boiling water with 24 polyethylene terephthalate filaments having a total denier of 50 and an individual filament denier of 2.08 and exhibiting a high shrinkage of 17% in boiling water.

The fabric was scoured, relaxed, dried, pre-set, dyed, adn dried in accordance with a usual method for polyester babric, while controlling the tension applied to the fabric to as small as possible. Especially, in the relaxing step, the fabric was treated under a very small tension so that loop-shaped fluffs are formed due to the difference in the shrinkage in boiling water.

The dyed fabric was subjected to the same water-repellent treatment as that described in Example 1.

The resultant water-repellent fabric was heat calendered at a temperature of 170° C. under a pressure of 60 kg/cm, by using a calender comprising a metal roll and a paper roll in such a manenr that the upper surface of the fabric came into contact with the paper roll and the lower surface of the fabric came into contact with the metal roll.

The upper surface of the resultnat calendered fabric was evenly covered with a number of loop-shaped, extremely fine fluffs and exhibited an excellent water-repellenet property.

The resultant fabric had surfaces which were finely, evenly rugged in the form of a crape surface and exhibited a sum of cover factors in the warp and weft directions of more than 3,000.

The water-repellent fabric was laundered five times under usual conditions and then subjected to a water-repellency test in accordance with the water-spraying method of JIS L-1092. As a result, it was found that the five-time laundered fabric exhibited 100 points of satisfactory water-repellent property.

The calendered fabric exhibited an air permeability of 0.6 ml/cm$^2$·sec and an excellent wind-breaking property.

For the purpose of comparison, the same procedures as those described above were carried out except that no calendering procedure was applied to the fabric.

The resultant comparative fabric exhibited an unsatisfactory water-repellent property and a large air permeability of 7.5 ml/cm$^2$·sec.

EXAMPLE 3

A high density plain weave fabric having a warp density of 184 yarns/3.79 cm, a weft density of 104 yarns/3.79 cm, and a sum of cover factors in the warp and weft directions of 2,071 was produced from blend filament yarns consisting of a blend of 144 extremely fine polyethylene terephthalate filaments having a total denier of 64 and an individual filament denier of 0.44 and exhibiting a low shrinkage of 8% in boiling water and 24 polyethylene terephthalate filaments having a total denier of 50 and an individual filament denier of 2.08 and exhibiting a high shrinkage of 17% in boiling water. The fabric was scoured, relaxed, dried, pre-heat set, dyed, dried, water-repellent treated, dried, and heat set in the same manner as that described in Example 1.

In the scouring and relaxing procedures, the tension applied to the fabric was controlled to as small as possible so as to allow the polyethylene terephthalate filaments in the fabric to satisfactorily shrink and to form finely, evenly rugged surfaces thereof.

The resultant water-repellent fabric had a sum of cover factors in the warp and weft directions of 2,360 and exhibited a moisture permeability of 6,000 g/m$^2$·24 hr and an air permeability of 8.0 ml/cm$^2$·sec.

The water-repellent fabric exhibited 100 points of water repellency determined in accordance with the water-spraying method of JIS L-1092. After being laundered five times, the fabric still exhibited 100 points of water repellency.

COMPARATIVE EXAMPLE 2

The same procedures as those described in Example 3 were carried out except that the comparative high density plain weave fabric was prepared from polyethylene terephthalate multifilament yarns having a yarn count of 128 denier/288 filaments and a twist number of 300 and exhibiting a shrinkage of 8% in boiling water, and had a warp density of 155 yarns/3.79 cm, a weft density of 114 yarns/3.79 cm, and a sum of cover factors in the warp and weft directions of 2,040.

The resultant water-repellent fabric had a flat surface and exhibited a sum of cover factors in the warp and weft directions of 2,237, a moisture permeability of 6,500 g/m$^2$·24 hr, and an air permeability of 0.53 ml/cm$^2$·sec.

After being laundered five times, the laundered fabric exhibited an unsatisfactory 80 to 90 points of water repellency.

EXAMPLE 4

A high density double weave fabric was prepared in which a surface plain weave layer having a warp density of 32 yarns/2.54 cm, a weft density of 33 yarns/2.54 cm, and a sum of cover factors in the warp and weft directions of 796 was composed of polyethylene terephthalate multifilament yarns having a yarn count of 150 denier/72 filaments, and a back plain weave layer having a warp density of 96 yarns/2.54 cm, a weft density of 99 yarns/2.54 cm, and a sum of cover factors in the warp and weft directions of 1,689 was composed of polyethylene terephthalate multifilament yarns having a yarn count of 75 denier/72 filaments.

The same procedures as those described in Example 1 were applied to the above-mentioned double weave fabric, except that the water-repellent treated fabric was calendered at a temperature of 180° C. under a pressure of 60 kg/cm.

In the resultant water-repellent fabric, the sums of cover factors in the warp and weft directions of the surface and back weave layers were 876 and 1,857, respectively, and the ratio of the sum of cover factors in the warp and weft directions of the surface weave layer to that of the back weave layers was about 47%.

The water-repellent fabric exhibited a low air permeability (wind-passing property) of 2 ml/cm$^2$·sec.

When a water drop was placed on the surface weave layer surface of the fabric, the water drop substantially took the form of a sphere. That is, the fabric exhibited an excellent water-repellent property.

COMPARATIVE EXAMPLE 3

The same procedures as those described in Example 4 were carried out except that the double weave fabric was replaced by a high density plain fabric prepared from polyethylene terephthalate multifilament yarns having a yarn count of 75 denier/ 72 filaments. The resultant comparative water-repellent fabric had a warp density of 119 yarns/2.54 cm a weft density of 106 yarns/2.54 cm, and a sum of cover factors in the warp and weft directions of 1,949. The ratio of the cover factor in the warp direction to that in the weft direction was 52:48.

The comparative water-repellent fabric had an air permeability of 1.0 ml/cm$^2$·sec.

When a water drop was placed on the surface of the comparative water-repellent fabric, the water drop took in the form of an ovoid. That is, the water-repellent property of the comparative fabric was poorer than that of the water-repellent fabric of Example 4.

We claim:

1. A high density, water-repellent textile fabric comprising a woven fabric comprising a number of warps and wefts each consisting of a number of extremely fine, water-repellent fibers having a denier of 1.2 or less, which woven fabric has at least one finely rugged surface having a sum of cover factors in warp and weft directions of said fabric of from 1,400 to 3,400, which has been determined in accordance with the equation:

$$CF = n\sqrt{de}$$

wherein CF represents the cover factor of said fabric surface in the warp or weft direction thereof, n represents the number of the warps or wefts per inch in said fabric, and de represents a denier of each warp or weft in said fabric.

2. The textile fabric as claimed in claim 1, wherein said fabric surface has a water-repellent fluff layer comprising a number of extremely fine, water-repellent fluffs extending outward from said fabric surface.

3. The textile fabric as claimed in claim 2, wherein said fluffs are in the form of loop piles.

4. The textile fabric as claimed in claim 3, wherein said loop-pile-formed fluff layer has a height of 1000 microns or less.

5. The textile fabric as calimed in claim 4, wherein said loop-pile-formed fluff layer has a height of from 1 to 400 microns.

6. The textile fabric as claimed in any of claims 1 to 5, wherein said loop-pile-formed fluffs are ones produced in such a manner that said woven fabric is produced from warps and wefts each comprising a blend of two types of synthetic extremely fine filaments which are different in heat shrinkage from each other, and is heated to cause portions of one type of the filaments having a smaller heat shrinkage than that of the other type of the filaments to form loop piles.

7. The textile fabric as claimed in claim 6, wherein the difference in the heat shrinkages between said two types of synthetic filaments is 7% or more under the heating conditions.

8. The textile fabric as claimed in claim 1, wherein said woven fabric is a double weave composed of a surface weave layer corresponding to said finely rugged fabric surface and a back weave layer, said back weave layer comprising a number of warps and wefts each consisting of a number of extremely fine synthetic filaments having a denier of 1.1 or less, and having a sum of cover factors in the warp and weft directions, of from 1,600 to 2,400, and said surface weave layer comprising a number of warps and wefts each consisting of a number of thermoplastic synthetic filaments having a denier of 1.0 or more and having a sum of cover factors in the warp and weft directions, of from $\frac{1}{4}$ to 1.0 time that of said back weave layer.

9. The textile fabric as claimed in claim 8, wherein said back weave layer has a ratio of the cover factor in the warp direction to that in the weft direction, of from 49:51 to 70:30.

10. The textile fabric as claimed in claim 8 or 9, wherein said warps and wefts in said surface weave layer consist of synthetic multifilament yarns.

11. The textile fabric as claimed in claim 2, wherein said fluffs are in the form of cut piles.

12. The textile fabric as claimed in claim 11, wherein the denier of said extremely fine, water-repellent fibers is 1.0 or less.

13. The textile fabric as claimed in claim 11 or 12, wherein the sum of cover factors in warp and weft directions of said fabric is in the range of from 2000 to 2500.

14. The textile fabric as claimed in any of claims 11 to 13, wherein said cut-pile-formed fluff layer has a height of 1000 microns or less.

15. The textile fabric as claimed in claim 14, wherein said cut pile-formed fluff layer has a height of from 10 to 100 microns.

16. The textile fabric as claimed in claim 11, wherein said cut-pile-formed fluffs are ones formed by raising the fabric surface.

17. The textile fabric as defined in claim 1, wherein said warps and wefts comprise extremely fine, water-repellent polyester filaments only.

18. The textile fabric as claimed in claim 1, wherein said warps and wefts comprise a blend of extremely fine, water-repellent polyester filaments and polyamide filaments.

* * * * *